US009030317B1

(12) United States Patent
Alexander

(10) Patent No.: US 9,030,317 B1
(45) Date of Patent: May 12, 2015

(54) COCKTAIL-RING WITH SELF-DEFENSE ALARM

(71) Applicant: Smart Siren Technology, Inc., New York, NY (US)

(72) Inventor: Katharyn Maris Alexander, New Paltz, NY (US)

(73) Assignee: Smart Siren Technology, Inc, New York, NY (US)

( * ) Notice: Subject to any disclaimer, the term of this patent is extended or adjusted under 35 U.S.C. 154(b) by 316 days.

(21) Appl. No.: 13/622,813

(22) Filed: Sep. 19, 2012

Related U.S. Application Data

(60) Provisional application No. 61/657,412, filed on Jun. 8, 2012.

(51) Int. Cl.
*G08B 1/08* (2006.01)
*G08B 25/01* (2006.01)

(52) U.S. Cl.
CPC ..... *G08B 25/016* (2013.01)

(58) Field of Classification Search
CPC ..... G08B 21/0297; G08B 1/08; G08B 2001/085; G08B 25/016; G08B 5/002
USPC ..... 340/539.1, 539.11, 574, 321, 384.4, 340/522, 531, 539.3, 540, 546, 573.1, 5.61, 340/5.65, 692
See application file for complete search history.

(56) References Cited

U.S. PATENT DOCUMENTS

| | | | | |
|---|---|---|---|---|
| 2,584,087 | A | | 1/1952 | Barbieri |
| 3,392,276 | A | | 4/1966 | Roman |
| 3,825,833 | A | * | 7/1974 | Bogue et al. ..... 455/100 |
| 4,009,381 | A | | 2/1977 | Schreiber et al. |
| 4,535,324 | A | * | 8/1985 | Levental ..... 340/574 |
| 5,307,047 | A | * | 4/1994 | Morioka ..... 340/384.4 |
| 5,438,315 | A | | 8/1995 | Nix |
| 5,622,062 | A | | 4/1997 | Gong-Hwa |
| 6,928,834 | B2 | | 8/2005 | Robertson et al. |

* cited by examiner

*Primary Examiner* — Brian Zimmerman
*Assistant Examiner* — Thomas McCormack
(74) *Attorney, Agent, or Firm* — Day Pitney LLP

(57) ABSTRACT

A cocktail-ring with self-defense alarm that allows a person in distress to trigger a loud audio alarm from the cocktail-ring. The cocktail-ring comprises a trigger assembly, a ring head base, and a ring shank. The trigger assembly comprises a circuit board with a magnetic proximity sensor. The circuit board also houses all the electrical components used to control the flow of logic and generate the audio alarm signal, such as transducers, power supply, process timers, oscillators, output drivers, and the like. An upper ring jewel and a ring head base form the housing for the trigger assembly. When the upper ring jewel is depressed and rotated about a track, located within the ring head base, into a locked position, the sensor may be activated, causing the control circuitry and transducers to generate a loud audio sound to deter potential attackers or alert third-parties of a potential danger.

17 Claims, 8 Drawing Sheets

COCKTAIL-RING WITH SELF-DEFENSE ALARM

CROSS-REFERENCE TO RELATED APPLICATION

This Non-Provisional application claims the benefit of U.S. Provisional Patent application Ser. No. 61/657,412, filed on Jun. 8, 2012, which is incorporated herein in its entirety.

FIELD OF THE INVENTION

The present invention relates to a portable security alarm device, and more particularly, a decorative cocktail-ring having a security alarm integrated into the ring, which enables a user to easily employ an audible security alarm during an emergency situation in order to deter an attack or threatened attack.

BACKGROUND OF THE INVENTION

Physical attacks against individuals for a variety of reasons are not uncommon. Some of the most common reasons for physical attacks are theft, rape, and random acts of assault. Woman are often the target of such physical attacks because they may be perceived to be more vulnerable and/or less prone to successfully defend themselves, particularly against a male attacker that is more physically dominant. Unfortunately, regardless of the preventative precautions that may be taken by women, there is no way to reduce the risk of such physical attacks to zero. It is impractical for a woman to be accompanied by another individual twenty-four hours per day.

Existing portable security alarm devices are inadequate. Many of them may be too large and cumbersome to carry in a women's purse, particularly if the purse is a small clutch or other small bag that is appropriate for certain social events. Even if a woman chooses to carry such a device in her purse, the device, stored in the purse, is not readily available during an unexpected attack. During an unexpected attack, a woman is not likely to have the time to unzip her purse, shuffle through the other items in her purse, and find the security alarm device. In fact, during a tense moment of attack, a woman may actually forget the she has the security alarm device in her purse. Even if the woman is able to retrieve the device, some devices are cumbersome or difficult to activate, especially during a tense moment of attack. The portable security alarm devices that are meant to be worm on a woman's person, rather than in her purse, are often unattractive and inappropriate to wear for certain social and professional events. Such drawbacks discourage women from purchasing and utilizing portable security alarm devices.

Importantly, many women who have not yet experienced an attack do not believe they will be attacked and, therefore, choose not to purchase or use a security alarm device. Cocktail-rings are becoming an increasingly popular fashion accessory, wearable by the style-conscious woman at a wide-range of social events, as an every-day accessory, as well as in a professional setting. Women, who may not purchase a generic security alarm device, may purchase an aesthetically desirable cocktail-ring that happens to have an added security feature.

Thus, there remains a need in the art to provide an aesthetically desirable fashion accessory, particularly a cocktail-ring, having a security alarm integrated within the cocktail-ring that is easily activated and encourages use.

SUMMARY OF THE INVENTION

The present invention overcomes the deficiencies of the known art and the problems that remain unsolved by providing a portable security alarm device wearable as a woman's decorative cocktail ring.

In accordance with one embodiment of the present invention, the invention consists of a security ring assembly, comprising:

a trigger assembly mounted inside a ring head base, the trigger assembly including a magnetic proximity sensor, a spring, and at least one transducer mounted on a printed circuit board, the printed circuit board being sized and shaped to be insertably engaged within a rotating collar body, a rotating collar body defining a circular flanged ring circumscribing the periphery of the printed circuit board, the rotating collar body having a plurality of rotating collar projections and a plurality of magnets, each rotating collar projection extending radially outward from an outer surface of the rotating collar body and each magnet attached to a surface of the rotating collar body, and a jewel cap being removeably attached to the rotating collar body; and a ring head base mounted on a top of a ring shank, the ring head base including a ring head base sidewall extending upwardly from a circular edge of a ring base interior bottom surface, the sidewall and bottom surface defining a ring base interior chamber that operates as an acoustic chamber for receiving alarm sound waves generated by the at least one transducer, a track formed along a periphery of the ring base interior chamber and adjacent to an interior surface of the ring head base sidewall, the track having a flat top surface, for allowing the rotating collar projections to glide along the track, and a plurality of audio apertures formed on the ring head base sidewall and through which alarm sound waves generated by the at least one transducer are projected;

wherein the track further comprises a plurality of track grooves, each track groove being sized and shaped to interlock with one of the plurality of rotating collar projections.

In a second aspect, each of the plurality of rotating collar projections is evenly spaced one from the other about the circumference of the rotating collar body.

In another aspect, each of the plurality magnets is evenly spaced one from the other about the circumference of the rotating collar body.

In another aspect, each of the plurality of rotating collar projections is cylindrical shaped.

In another aspect, the spring is centrally mounted on an upper surface of the printed circuit board and the spring vertically extends to a concave surface of the jewel cap, for providing resistance when a user presses down on the jewel cap and rotates the jewel cap to activate the security ring assembly.

In another aspect, the ring head base further comprises at least one decorative jewel located on an exterior surface of the ring head base.

In another aspect, the security ring assembly further comprises a power storage device mounted on the printed circuit board.

In another aspect, the power storage device is preferably an ultracapacitor.

In another aspect, the security ring assembly further comprises a delay timer circuit mounted on the printed circuit board, for preventing false triggering of the trigger assembly by ensuring that the magnetic proximity sensor remains in an "on" position for a predetermined amount of time.

In another aspect, the predetermined amount of time is approximately 0.5 to 1.5 seconds.

In another aspect, the printed circuit board comprises an orientation notch, defining an indentation on an edge of the printed circuit board, for proper placement of the printed circuit board into the ring head base, such that when the jewel cap is depressed and rotated until the rotating collar projections are interlocked with the track grooves, at least one of the plurality of magnets is in sufficient proximity to the magnetic proximity sensor to switch the sensor to the "on" position.

Yet another aspect of the present invention provides a security ring assembly, comprising:

a trigger assembly mounted inside a ring head base, the trigger assembly including

- a magnetic proximity sensor, a spring, and at least one transducer mounted on a printed circuit board, the printed circuit board being sized and shaped to be insertably engaged within a rotating collar body,
- a rotating collar body defining a circular flanged ring circumscribing the periphery of the printed circuit board, the rotating collar body having a plurality of rotating collar projections and a plurality of magnets, each rotating collar projection extending radially outward from an outer surface of the rotating collar body and each magnet attached to an inner surface of the rotating collar body, and
- a jewel cap having a projecting wall extending outwardly from a bottom portion of a concave inner surface of the jewel cap, the projecting wall having an L-shaped cross-section and forming a circular groove extending along a circumference of a bottom edge of the jewel cap, for insertion therein of an upper flange member of the rotating collar body into the circular groove; and a ring head base mounted on a top of a ring shank, the ring head base including

- a ring head base sidewall extending upwardly from a circular edge of a ring base interior bottom surface, the sidewall and bottom surface defining a ring base interior chamber that operates as an acoustic chamber for receiving alarm sound waves generated by the at least one transducer,
- a track formed along a periphery of the ring base interior chamber and adjacent to an interior surface of the ring head base sidewall, the track having a flat top surface, for allowing the rotating collar projections to glide along the track in a clockwise and counterclockwise direction, and
- a plurality of audio apertures formed on the ring head base sidewall and through which alarm sound waves generated by the at least one transducer are projected;

wherein the track further comprises a plurality of track grooves, each track groove being sized and shaped to interlock with one of the plurality of rotating collar projections.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
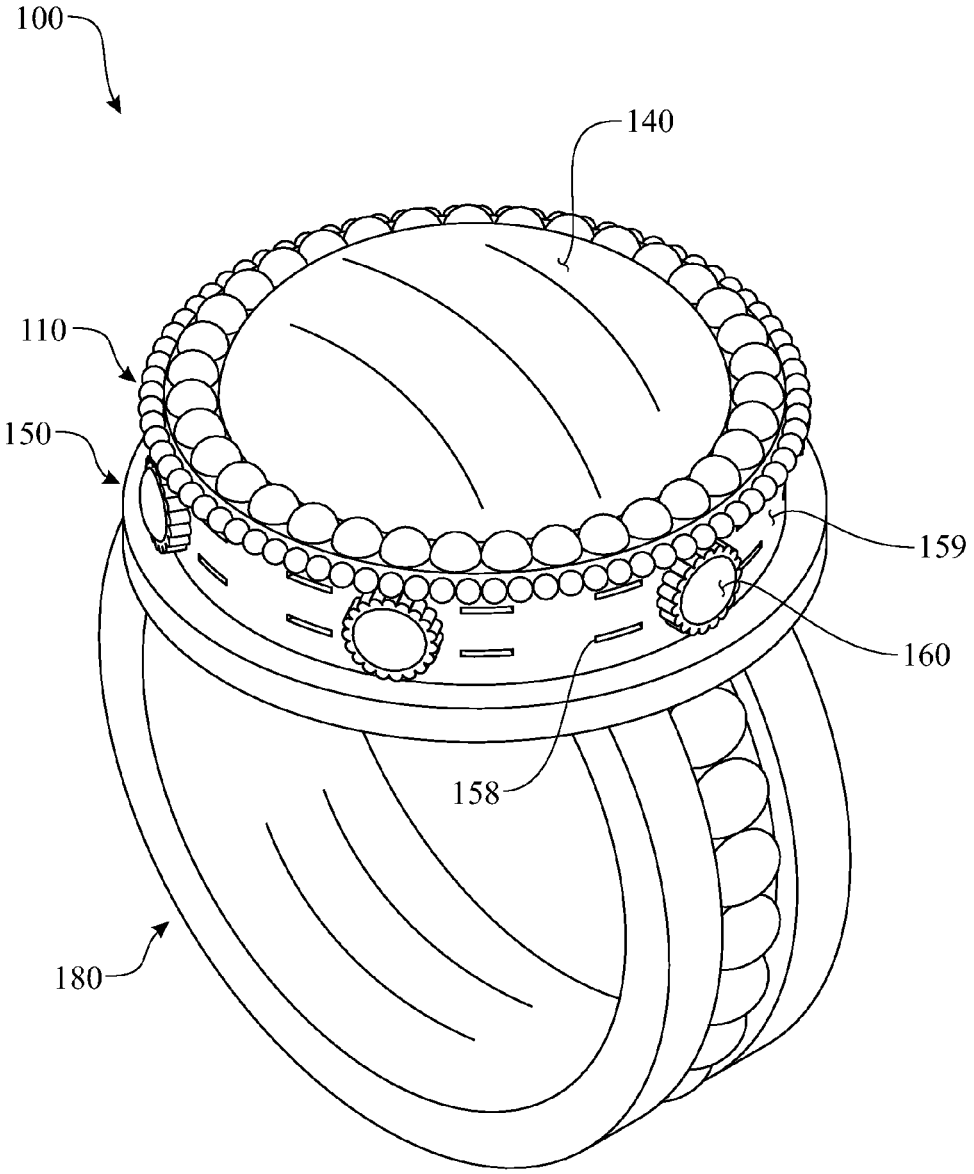
FIG. 1 presents an isometric view of an exemplary cocktail-ring with self-defense alarm.
Figure 2:
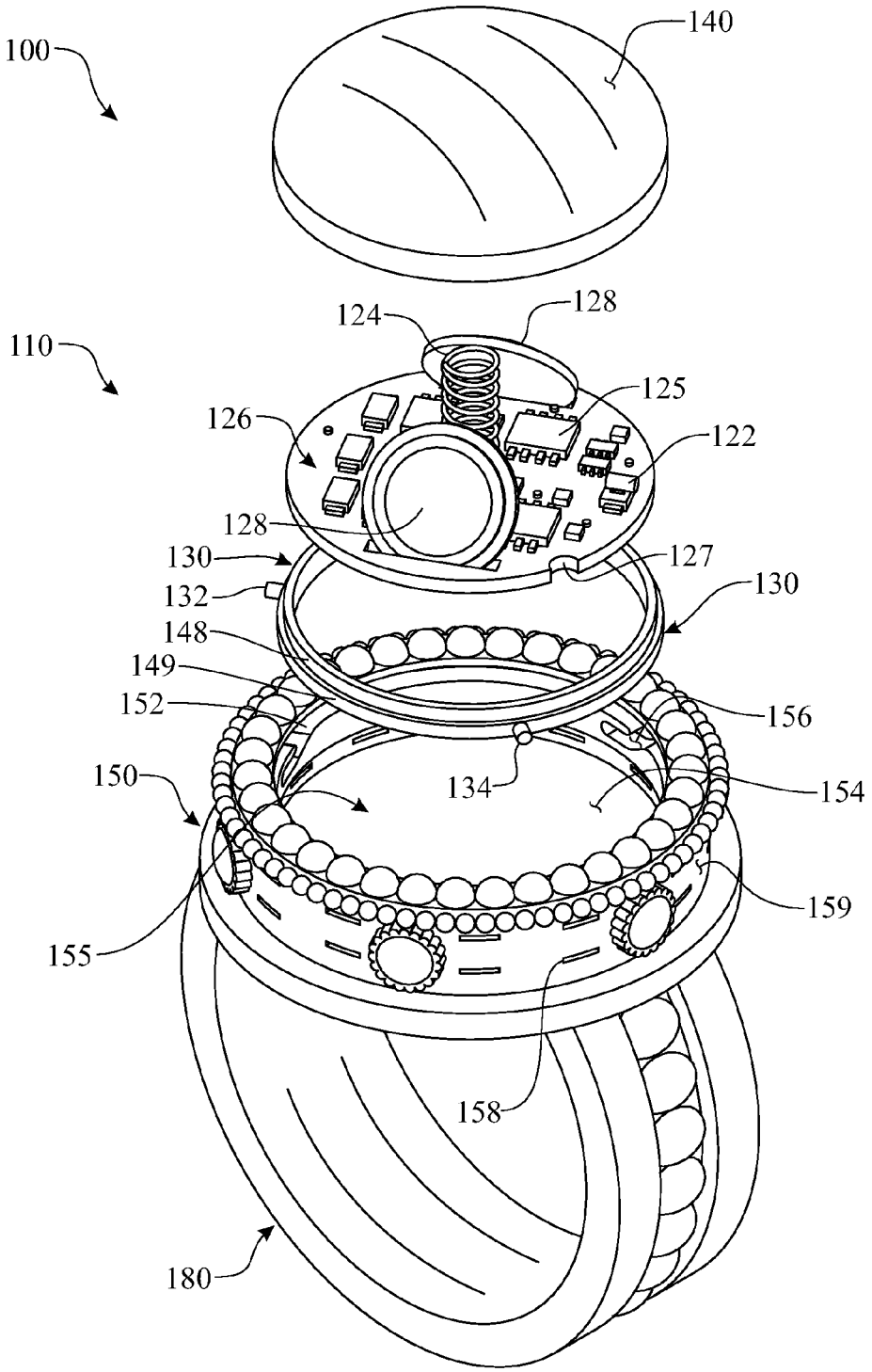
FIG. 2 presents an isometric, exploded assembly view of the cocktail-ring with self-defense alarm originally introduced in FIG. 1.
Figure 3:
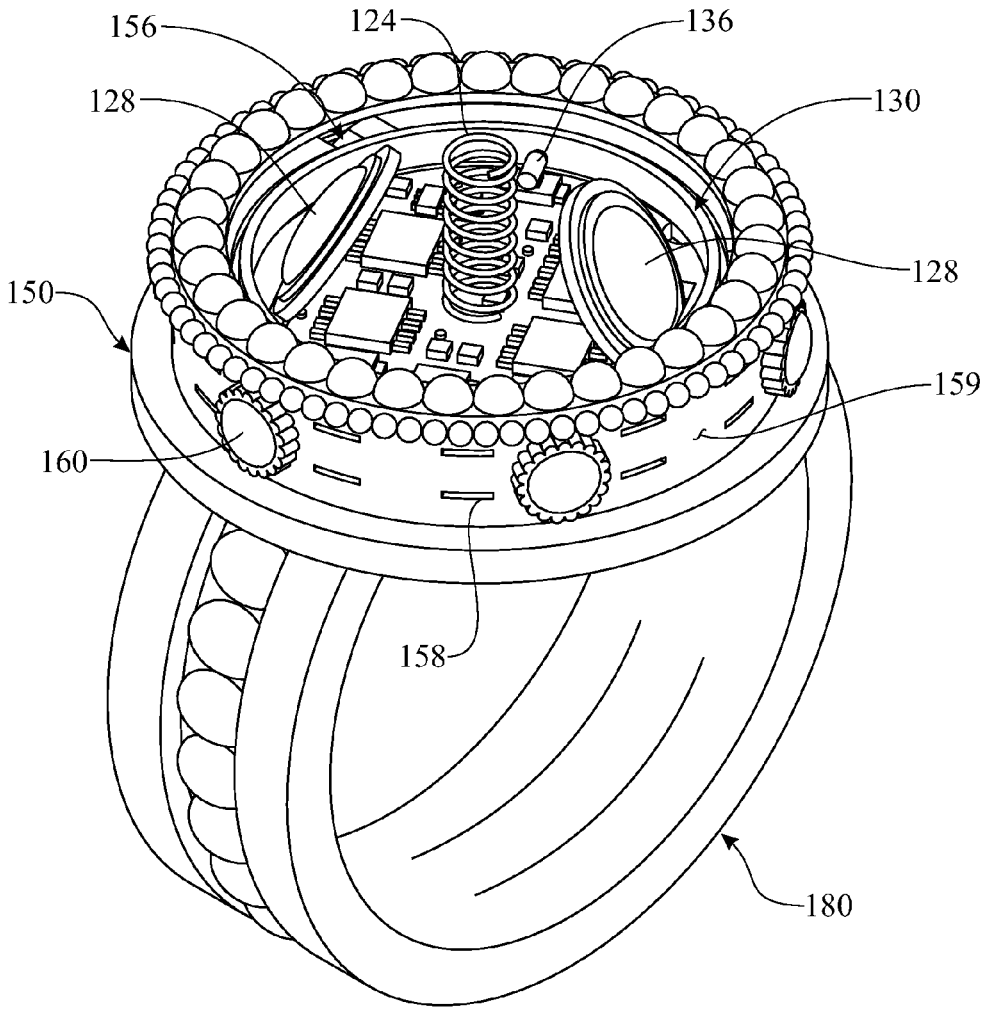
FIG. 3 presents an isometric view of the cocktail-ring with self-defense alarm originally introduced in FIG. 1, illustrated without a jewel cap.
Figure 4:
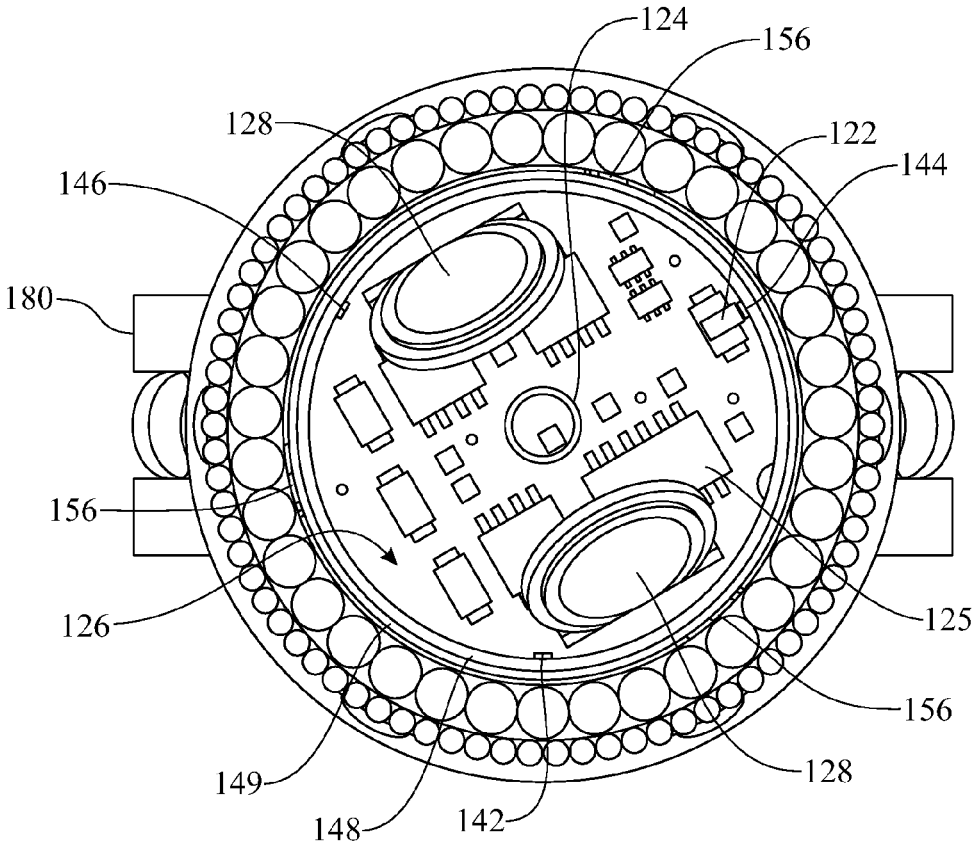
FIG. 4 presents a plan view of the cocktail-ring with self-defense alarm originally introduced in FIG. 1, illustrated without the jewel cap.

A security ring assembly 100 is presented in FIG. 1. The security ring assembly 100 includes a ring head 110 mounted to a ring shank 180. The ring head 110 comprises a trigger assembly 120 integrated into a ring head base 150.

Figure 5:
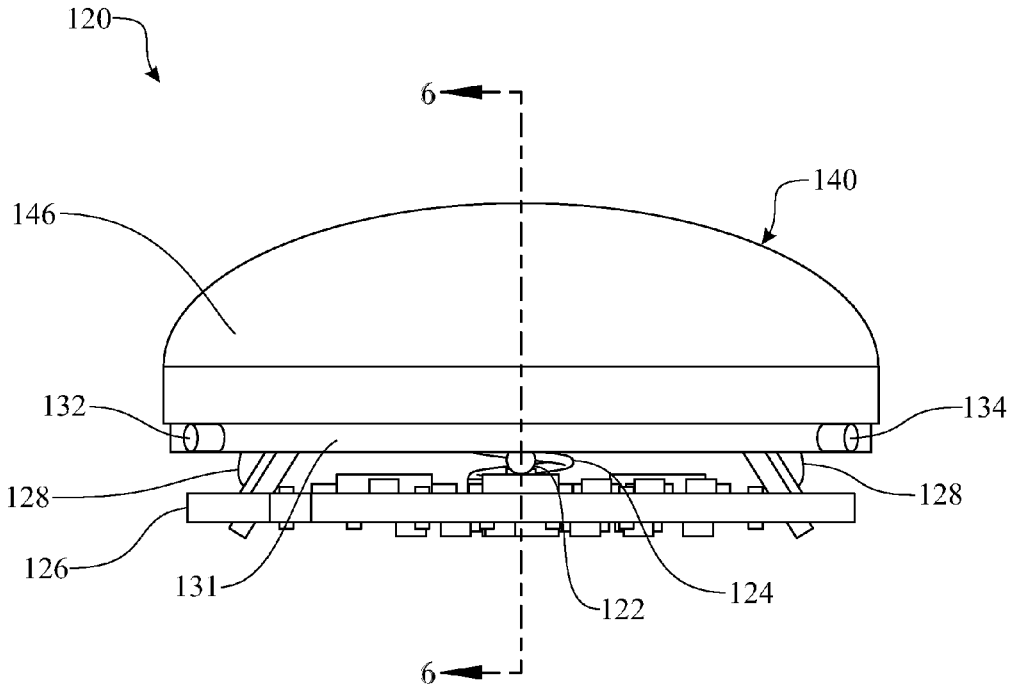
FIG. 5 presents a side elevation view of the trigger assembly of the cocktail-ring with self-defense alarm originally introduced in FIG. 1.
Figure 6:
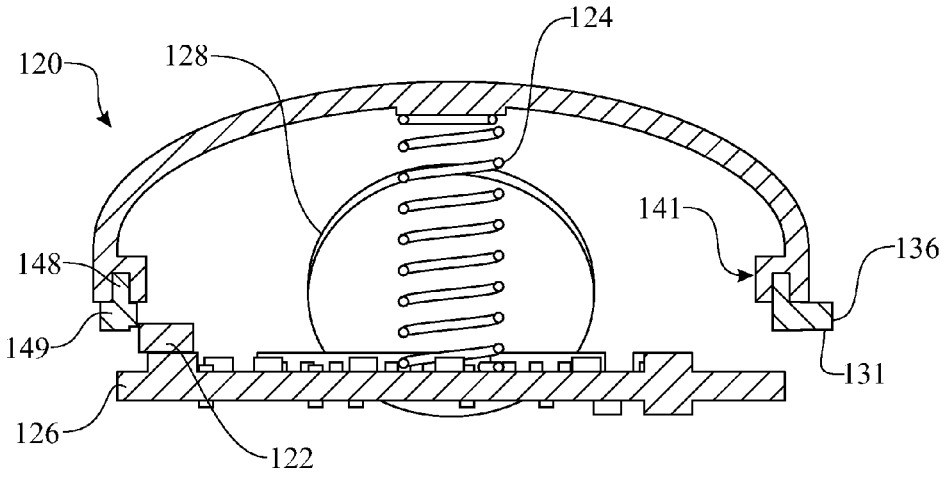
FIG. 6 presents a sectioned side elevation view of the trigger assembly of the cocktail-ring with self-defense alarm originally introduced in FIG. 1, the section being taken along line 6-6 of FIG. 5.
Figure 7:
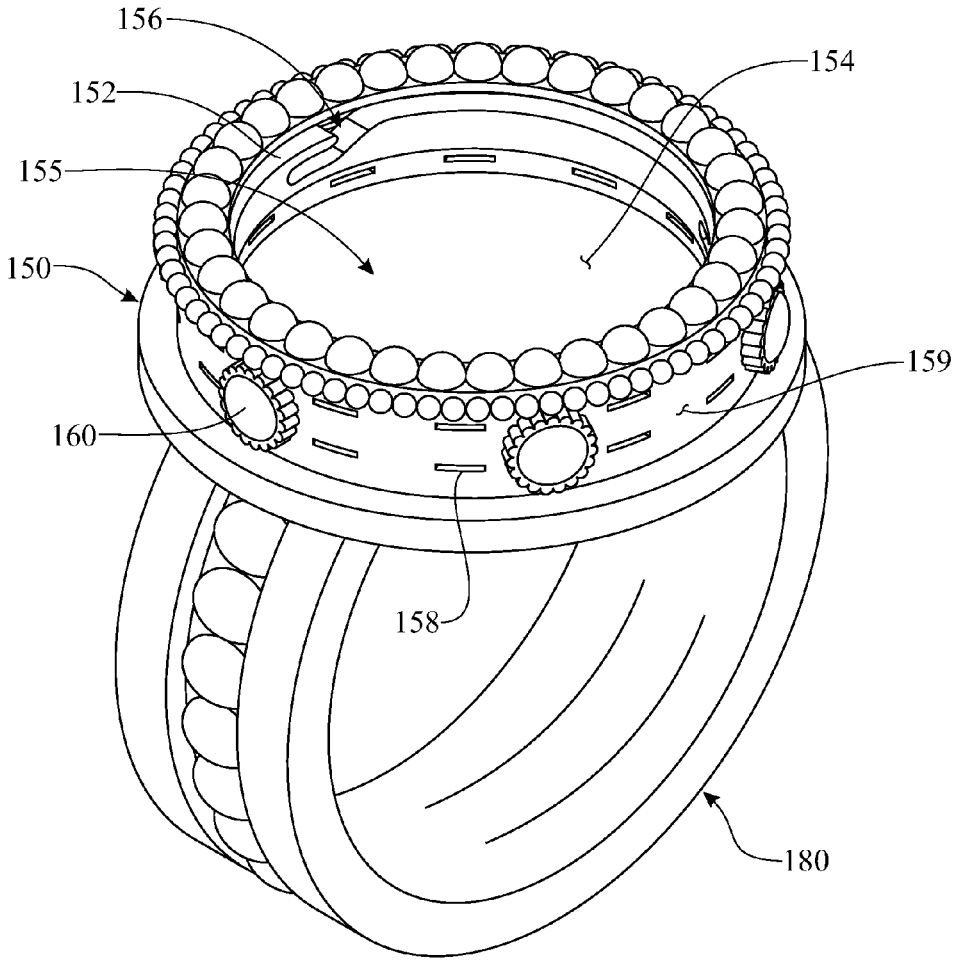
FIG. 7 presents an isometric view of the cocktail-ring with self-defense alarm originally introduced in FIG. 1, illustrated without the jewel cap and the trigger assembly.
Figure 8:
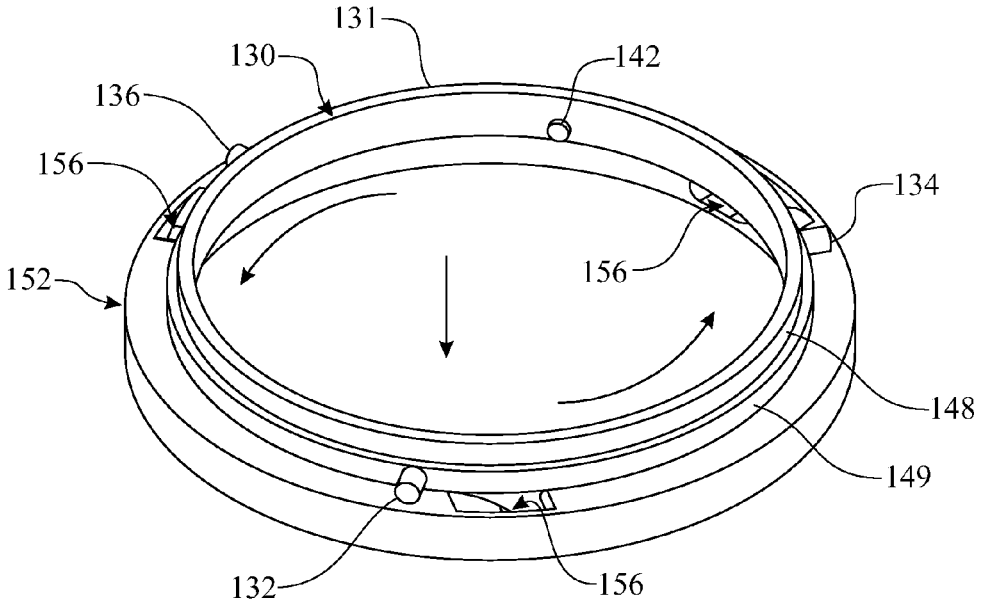
FIG. 8 presents an isometric view of a rotating collar engaged with a track, in an unlocked position.
Figure 9:
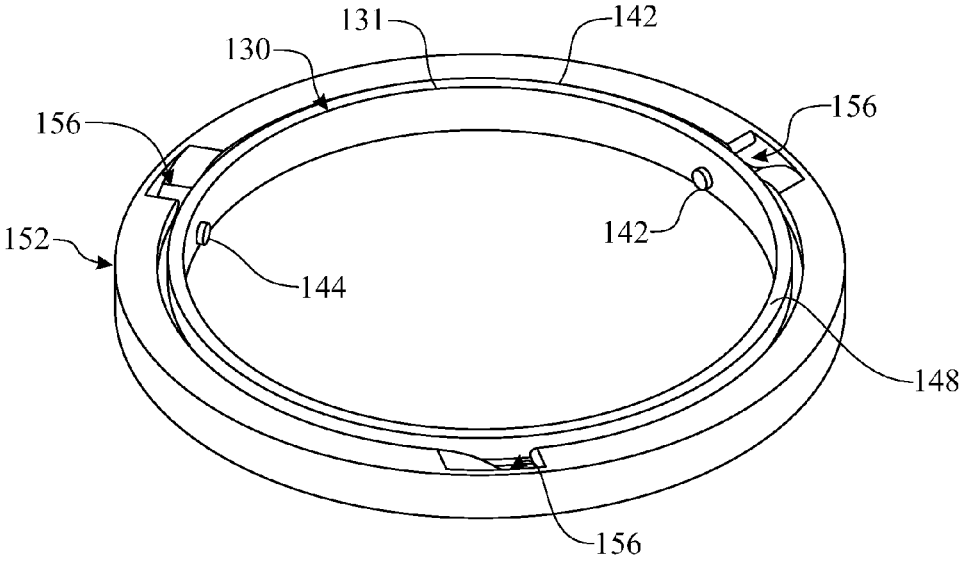
FIG. 9 presents an isometric view of the rotating collar projections of the rotating collar engaged with the groove cutouts of the track, illustrating a locked position wherein the magnets required to activate the magnetic proximity sensor are aligned.

The trigger assembly 120 comprises a magnetic proximity sensor 222, a spring 124, a printed circuit board (PCB) 126, a transducer 128, a jewel cap 140, and a rotating collar 130, as illustrated in FIGS. 5 and 6. The trigger assembly 120 is mounted inside the ring head base 150. The PCB 126 is sized and shaped to be insertably engaged within a rotating collar body 131, as illustrated in FIGS. 8 and 9. The exemplary PCB 126 is a thin circular disc, however, it is understood that the PCB 136 can be formed in other shapes, such as an oval, rectangle or square. As is well-known in the art, the PCB 126 provides mechanical support and electrical connection for electric components attached onto the PCB 126 via conductive pathways etched onto a non-conductive PCB substrate. The PCB comprises an orientation notch 127, defining an indentation on an edge of the PCB 126, for proper placement of the PCB 126 into a ring head base 150 and proper alignment of the PCB 126 with the rotating collar projections 132, 134, 136 and magnets 142, 144, 146 located on a rotating collar body 131 of the rotating collar 130. The electrical components attached onto the PCB 126 include the magnetic proximity sensor 222, a power source, transducers 128, and control circuitry 125. The exemplary magnetic proximity sensor 222 is a sealed magnetically activated reed switch, being in an off configuration when the security ring assembly 100 is in an unactivated state. It is understood that the sensor 222 may be any type of magnetic proximity sensor that is suitable for executing the safety feature of the security ring assembly 100 in accordance with the present invention. The exemplary power source is a power storage device, specifically an ultracapacitor or equivalent power storage device, having a negligible power loss over an extended period of time, thereby providing the security ring assembly 100 with a relatively long shelf-life. Two transducers 128 are mounted on opposite ends of the PCB 126. The transducer 128 provides the speaker functionality of the security ring assembly 100, the transducer 128 being capable of emitting a loud alarm sound upon activation of the security ring assembly 100. The control circuitry 125 executes the logic required to activate the alarm sound in accordance with the present invention, enabling the safety feature of the security ring assembly 100 to be implemented. The control circuitry 125 may include an integrated circuit (IC), read-only memory (ROM), a microcontroller, or other well-known electrical components that may be utilized to execute the control logic in accordance with the present invention. Other electrical components may be included on the PCB 126 to provide additional functionality, such as a radio frequency (RF) transmitter to activate a remote device, a global positioning system (GPS) transmitter for transmitting location information to a remote receiver, or a Bluetooth device for communicating with a cellular telephone.

The spring 124 is centrally mounted on the upper surface of the PCB 126 and vertically extends to the concave surface of the jewel cap 140. The spring 124 keeps the jewel cap 140 and the rotating collar body 131 under tension when the alarm is in an unactivated state and the spring 124 allows for resistance when a user presses down on the jewel cap 140 and rotates the jewel cap 140 to activate the security ring assembly 100.

As illustrated in FIGS. 8 and 9, the rotating collar 130 comprises a rotating collar body 131, a plurality of rotating collar projections 132, 134, 136, and a plurality of magnets 142, 144, 146. The rotating collar body 131 defines a circular flanged ring comprising an upper flange member 148 and a lower flange member 149. The upper flange member 148 forms a circular ring having a circumference slightly greater than the circumference of the lower flange member 149. The upper flange member 148 defines an internal rim or lip projecting upwardly from the top surface of the lower flange member 149. In the exemplary embodiment, the rotating collar 130 comprises three rotating collar projections 132, 134, 136 and three magnets 142, 144, 146, each rotating collar projection 132, 134, 136 being evenly spaced one from the other about the circumference of the rotating collar body 131 and each magnet 142, 144, 146 being evenly spaced one from the other about the circumference of the rotating collar body 131. The rotating collar projections 132, 134, 136 are cylindrical shaped projections extending radially outward from the outer surface of the rotating collar body 131. The magnets 142, 144, 146 are attached to the inner surface of the rotating collar body 131. The rotating collar 130 is preferably a polymer material, such as polyoxymethylene or nylon.

The jewel cap 140 is domical in shape. As illustrated in FIG. 6, the jewel cap 140 is sized and shaped to engage the rotating collar body 131. The jewel cap 140 includes a projecting wall 141 extending outwardly from a bottom portion of the concave inner surface of the jewel cap 140, the projecting wall 141 having an L-shaped cross-section and forming a circular groove extending along the circumference of the bottom edge of the jewel cap 140, for insertion therein of the upper flange member 148 of the rotating collar body 131 into the circular groove.

The ring head base 150 comprises a track 152, a ring base interior bottom surface 154, a ring base interior chamber 155, a ring head base sidewall 159, and a plurality of audio apertures 158. The ring head base 150 is affixed to a top of the ring shank 180, for housing the trigger assembly 120. The exemplary ring head base 150 is cylindrical-shaped, however, it is understood that the base 150 can be formed in other shapes, such as rectangular or square-shaped. The ring head base sidewall 159 extends upwardly from the circular edge of the ring base interior bottom surface 154, the sidewall 159 and bottom surface 154 defining a ring base interior chamber 155 that operates as an acoustic chamber for receiving alarm sound waves generated by the transducers 128. The ring head base 150 includes a plurality of audio apertures 158 formed on the ring head base sidewall 159 and through which alarm sound waves generated by the transducers 128 are projected. The ring head base 150 may further comprise one or more decorative jewels 160 located on the exterior surface of the ring head base 150, for decorative purposes. The track 152 is a circular track formed along the periphery of the ring base interior chamber 155 and adjacent to the interior surface of the ring head base sidewall 159. The track 152 includes a flat top surface, for allowing the rotating collar projections 132, 134, 136 to glide along the track 152 in a clockwise and counterclockwise direction. The track 152 comprises a plurality of track grooves 156, each track groove 156 being sized and shaped to interlock with one of the plurality of rotating collar projections 132, 134, 136 when a user presses down on the jewel cap 140 and rotates the jewel cap 140 to activate the security ring assembly 100.

The ring shank 180 defines a circular band for mounting the security ring assembly 100 on the user's finger. The ring shank 180 extends from a bottom wall of the ring head base 150.

Figure 10:
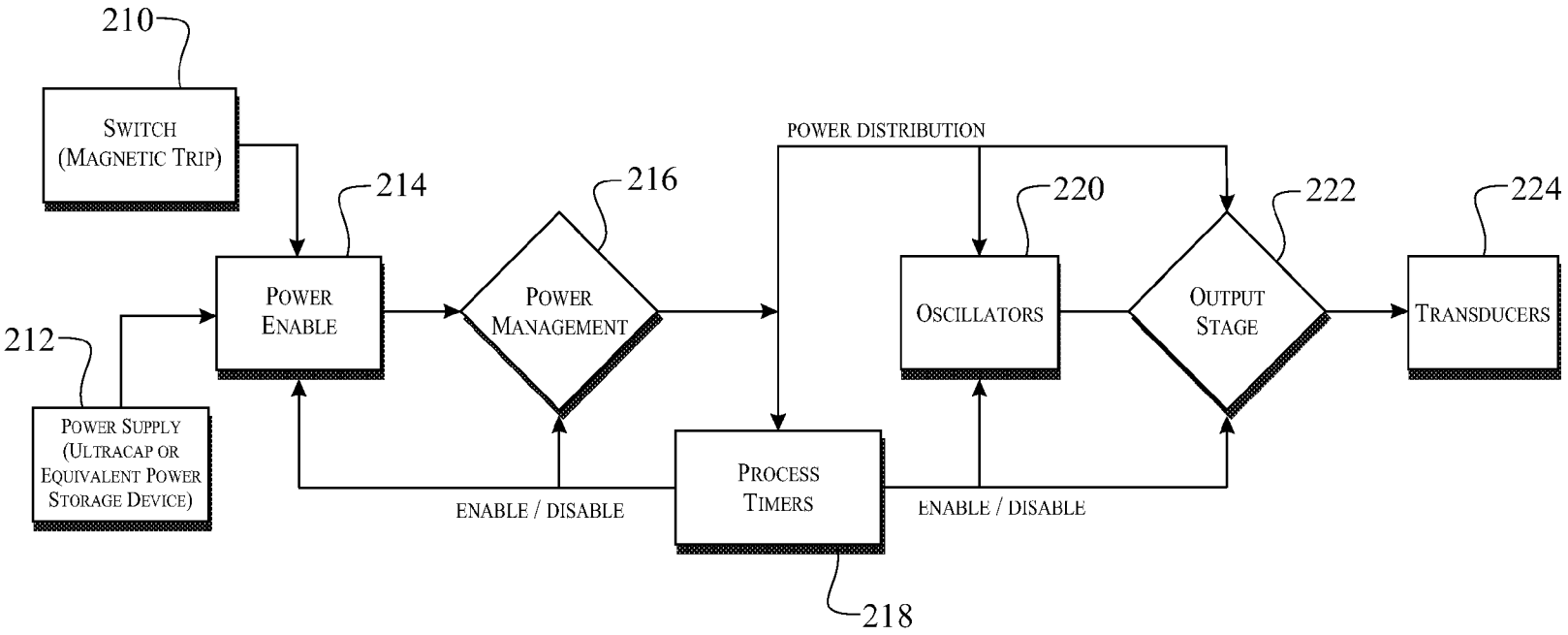
FIG. 10 presents a flowchart illustrating the operation of the self-defense alarm of the cocktail-ring.

A flowchart showing the operation of the security ring assembly 100 is illustrated in FIG. 10. The process is initiated when the switch (magnetic proximity sensor 122) is activated 210, i.e. transitioned from the "off" position to the "on" position. The magnetic proximity sensor 122 is, by default, in the "off" position. When the jewel cap 140 is depressed and rotated in a counterclockwise direction until the rotating collar projections 132, 134, 136 are interlocked with the track grooves 156, at least one of the plurality of magnets 142, 144, 146 is in close proximity to the magnetic proximity sensor 122, thereby activating the sensor 122 to the "on" position. When the switch is in the "on" position, power is supplied from the power supply 212 to the power enable circuit 214.

The power supply 212 is preferably a power storage device, such as an ultracapacitor or supercapacitor. Unlike batteries, power storage devices such as ultracapacitors have high power density characteristics while providing negligible power loss over a prolonged period of time. The power enable circuit 214 powers the power management circuit 216. The power management circuit 216 manages the power supply to the process timers 218, oscillators 220, and the output stage drivers 222. The process timers 218 include the delay timer and the alarm timer. Initially, the power management circuit 216 supplies low voltage to a delay timer 218. The delay timer 218 prevents false triggering by ensuring that the switch remains in the "on" position for a predetermined amount of time, preferably approximately 0.5 to 1.5 seconds. If the switch is transitioned to the "off" position during the delay timer, the power enable circuit 214 is disabled, shutting down the activation cycle. On the other hand, if the switch remains in the "on" position for the predetermined amount of time, an alarm timer 218 is triggered to sound the alarm for a predetermined alarm period. The alarm timer 218 enables the power management circuit 216 to supply a higher voltage to the oscillators 220, output stage drivers 222, and transducers 224. The oscillators 220 generate the alarm audio signals, which are used to drive the output stage drivers 222. The amplified signal from the output stage drivers 222 are transmitted to the transducers 224, which produce the alarm sound waves for the predetermined alarm period. After the alarm period expires, the power enable circuit 214 is disabled, shutting the system down.

In use, when an emergency situation occurs, the user can depress the jewel cap 140, rotating the jewel cap 140 in a counterclockwise direction while the jewel cap 140 is depressed, until the rotating collar projections 132, 134, 136 are interlocked with the track grooves 156 of the ring head base 150. The alarm is then activated and generates a loud alarm sound for the predetermined alarm period. The loud alarm sound can alert nearby third-parties to an emergency or serve to deter a potential attacker.

The security ring assembly 100 provides several advantages over the current art. A portable security alarm wearable as a women's decorative cocktail ring allows the security alarm to be more readily available for easy activation during an unexpected emergency situation. The portable security alarm wearable as a decorative cocktail ring is more likely to be utilized by style-conscious women in a wide-range of social and professional settings. Moreover, the mechanical and electrical design of the security ring assembly 100 provides several advantages over the current art. The use of a power storage device rather than a battery allows for a longer shelf-life due to the negligible power drain of the power storage device during the "off" state of the security ring assembly 100. The rotate and interlock structure provided by the rotating collar 130 and track grooves 156 in addition to the delay timer 218 safeguard against accidental engagement, which significantly depletes the power supply 212.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A finger ring with a self-defense alarm, comprising:

a) a base portion;

b) an upper portion covering the base portion, base portion and upper portion cooperating to define a compartment, wherein the upper portion is rotatably displaceable with respect to the base portion;

c) at least one transducer disposed within the compartment;

d) a printed circuit board disposed in the compartment including circuitry for actuating the at least one transducer; and e) a power source in selective electrical communication with the at least one transducer by way of the printed circuit board, wherein the at least one transducer is actuated by rotating the upper portion with respect to the base portion.

2. The finger ring of claim 1, wherein rotating the upper portion with respect to the base portion activates a magnetically activated switch that then permits the at least one transducer to be activated.

3. The finger ring of claim 2, wherein the magnetically activated switch is operably coupled to the printed circuit board.

4. The finger ring of claim 3, wherein the magnetically activated switch includes a reed switch.

5. The finger ring of claim 1, wherein the printed circuit board includes an orientation notch for orienting the printed circuit board within the compartment.

6. The finger ring of claim 1, wherein the printed circuit board includes an electronic microcontroller.

7. The finger ring of claim 6, wherein the printed circuit board further includes a radio frequency (RF) transmitter configured to activate a remote device.

8. The finger ring of claim 6, wherein the printed circuit board further includes a global positioning system (GPS) transmitter for transmitting location information to a remote receiver.

9. The finger ring of claim 6, wherein the printed circuit board further includes a Bluetooth device.

10. The finger ring of claim 6, wherein the Bluetooth device is configured for communicating with a cellular telephone.

11. The finger ring of claim 1, wherein the power source includes an ultracapacitor.

12. The finger ring of claim 1, wherein the power source includes a supercapacitor.

13. The finger ring of claim 1, wherein the finger ring is configured to include a delay timer.

14. The finger ring of claim 13, wherein the delay timer is configured to prevent false triggering by requiring the finger ring to be activated for a predetermined period of time prior to activating the at least one transducer.

15. The finger ring of claim 14, wherein the finger ring is configured to include an alarm timer.

16. The finger ring of claim 15, wherein the alarm timer activates the at least one transducer if the finger ring is activated for the predetermined period of time.

17. The finger ring of claim 1, wherein a microcontroller disposed on the printed circuit board is configured to activate a voltage converter mounted on the printed circuit board when the microcontroller is actuated to step up voltage to drive the at least one transducer.

* * * * *